United States Patent [19]

Wright

[11] 4,221,194

[45] Sep. 9, 1980

[54] ELECTRONIC FUEL INJECTION CONTROL EMPLOYING GATE TO TRANSFER DEMAND SIGNAL FROM SIGNAL GENERATOR TO SIGNAL STORE AND USING DISCHARGE OF SIGNAL STORE TO CONTROL INJECTION TIME

[75] Inventor: Maurice J. Wright, Solihull, England

[73] Assignee: Lucas Industries Limited, Birmingham, England

[21] Appl. No.: 970,501

[22] Filed: Dec. 18, 1978

Related U.S. Application Data

[63] Continuation of Ser. No. 835,083, Sep. 20, 1977, abandoned, which is a continuation of Ser. No. 717,058, Aug. 23, 1976, abandoned.

[30] Foreign Application Priority Data

Sep. 5, 1975 [GB] United Kingdom ..... 36585/75

[51] Int. Cl.[3] ..... F02B 3/00

[52] U.S. Cl. ..... 123/478; 123/489; 123/491; 123/415

[58] Field of Search ..... 123/32 EA, 32 EE, 32 EG, 123/117 R

[56] References Cited

U.S. PATENT DOCUMENTS

| | | | |
|---|---|---|---|
| 3,613,644 | 10/1971 | Porsche | 123/32 EA |
| 3,651,343 | 3/1972 | Monpetit | 123/32 EA |
| 3,727,081 | 4/1973 | Davis et al. | 123/32 EA |
| 3,750,631 | 8/1973 | Scholl et al. | 123/32 EA |
| 3,771,502 | 11/1973 | Reddy | 123/32 EA |
| 3,916,170 | 10/1975 | Norimatsu et al. | 123/32 EE |
| 3,923,016 | 12/1975 | Hoshi | 123/32 EA |
| 3,991,726 | 11/1976 | Kawai et al. | 123/32 EA |
| 3,991,727 | 11/1976 | Kawai et al. | 123/32 EA |
| 4,121,545 | 10/1978 | Mizote | 123/32 EA |
| 4,133,326 | 1/1979 | Cops et al. | 123/32 EE |

FOREIGN PATENT DOCUMENTS

| | | |
|---|---|---|
| 1325975 | 8/1973 | United Kingdom . |
| 1445709 | 8/1976 | United Kingdom . |

*Primary Examiner*—P. S. Lall

*Attorney, Agent, or Firm*—Ladas & Parry

[57] ABSTRACT

An electronic fuel injection system includes a mass flow transducer, an integrator which periodically accumulates a signal corresponding to the total mass of air aspirated into the engine during a preceding fraction of an engine cycle, a signal storage capacitor which is charged periodically to the integrator output voltage under the control of an analog gate, a controlled current source normally giving a constant current, but overridingly controllable by the integrator output at extremes of the range of the integrator output and connected to discharge the capacitor and a comparator sensing the voltage on the capacitor and controlling the length of time for which the injector is open.

20 Claims, 4 Drawing Figures

BATTERY
HALL EFFECT SWITCH
HALL EFFECT SWITCH
MAGNET
MAGNET
FROM STARTER SOLENOID CONTACT

ELECTRONIC FUEL INJECTION CONTROL EMPLOYING GATE TO TRANSFER DEMAND SIGNAL FROM SIGNAL GENERATOR TO SIGNAL STORE AND USING DISCHARGE OF SIGNAL STORE TO CONTROL INJECTION TIME

This is a continuation of co-pending Application Ser. No. 835,083 filed Sept. 20, 1977, now abandoned, which is itself a continuation of co-pending Application Ser. No. 717,058 filed Aug. 23, 1976, now abandoned.

This invention relates to an electronic fuel injection control for an internal combustion engine.

An electronic fuel injection control in accordance with the invention comprises means for repeatedly generating a voltage signal related to the fuel requirement of the engine, gate means for periodically transferring said voltage signal to a signal storage means, means sensitive to at least one engine operating parameter for discharging said signal storage means at a rate determined by said engine operating parameter and means sensitive to the length of time which said signal storage means takes to discharge for controlling the quantity of fuel injected.

The system may include a plurality of seperate signal storage means each having its own associated gate means, the discharging means being common to said signal storage means.

The discharging means may be sensitive to the voltage signal itself.

Figure 1:
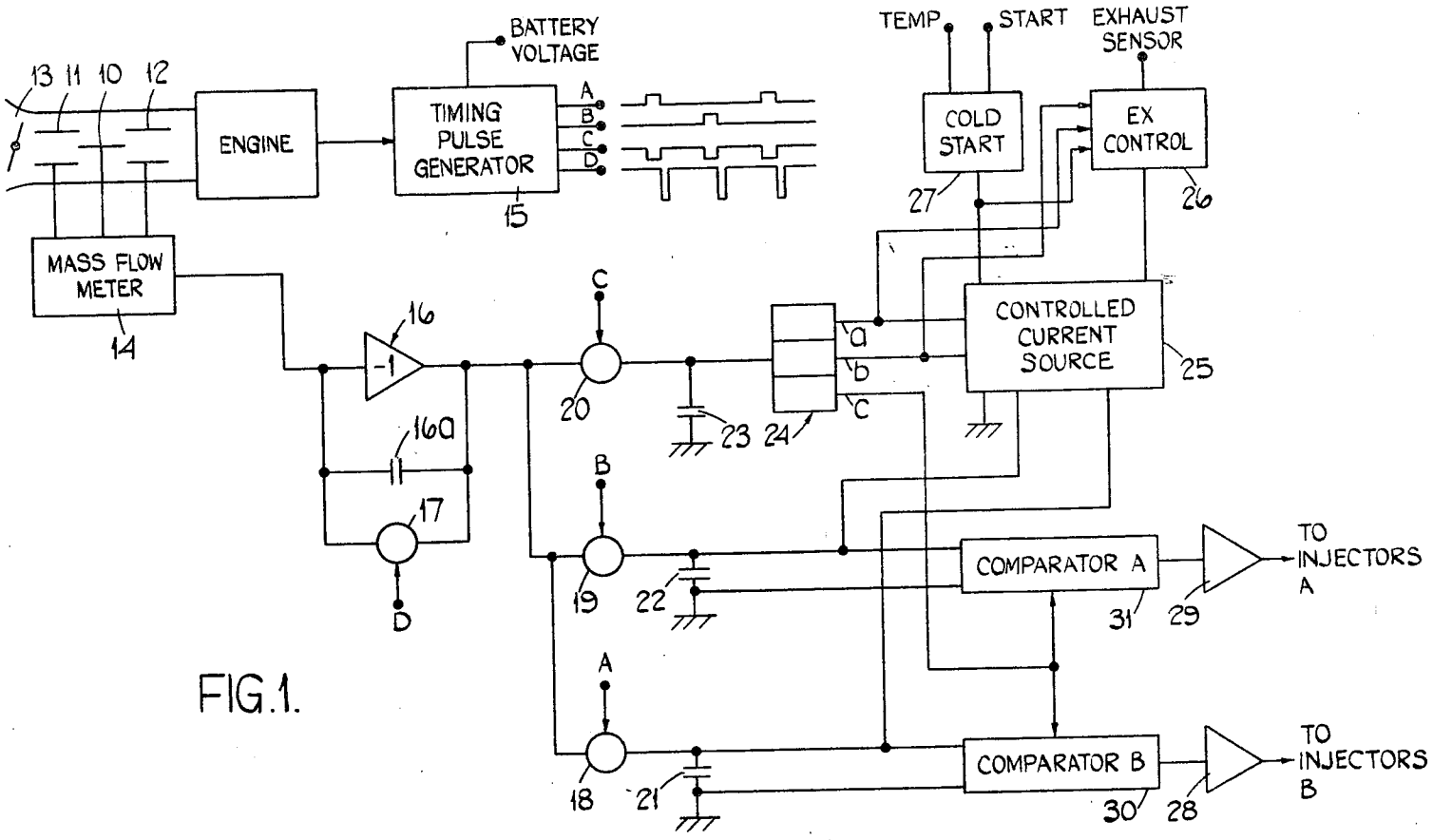
FIG. 1 is a schematic diagram of an example of the invention.

Referring firstly to FIG. 1, the control shown includes a mass flow meter of the known ion displacement type. Such meter includes an ion emitting electrode 10 and a pair of axially spaced ion collecting electrodes 11, 12 situated in the engine air intake manifold 13. A high voltage is maintained between the electrode 10 and the two electrodes 11, 12, such that a controlled total current flows. The difference between the currents received by the two electrodes 11, 12 is proportional to the mass flow along the manifold 13. The meter 14 acts in known manner to produce a voltage output signal proportional to this mass flow.

The engine drives a timing pulse generator 15 which produces pulses in synchronism with rotation of the engine crankshaft. Assuming the engine operates in the well known four stroke cycle, the generator produces a pulse train C which consists of one negative-going pulse per revolution of the engine. The length of each pulse varies with the battery voltage applied. The generator 15 also produces positive-going pulses A and B which occur simultaneously with alternate pulses C, and pulse train D which consists of fixed duration negative-going pulses triggered by the trailing edges of the pulses C.

The output of the meter 14 is applied to the input terminal of an electronic integrator 16, the capacitor 16*a* of which is periodically discharged by a switch 17 operated by pulse train D. The output of the integrator 16 is applied to three gates 18, 19, 20 which are opened by the pulses A, B and C respectively. These gates control the charging of three signal storage means in the form of capacitors 21, 22 and 23. Thus, the pulses A, B and C serve to open the gates 18, 19 and 20 periodically in synchronism with engine operation thereby to charge the capacitors with the output voltage of the integrator. The capacitor 23 acts as a form of memory which is up-dated once per engine cycle and the voltage across it is fed to a level detecting circuit 24 which has three output terminals namely an output terminal a which carries a negative-going signal whenever the voltage on capacitor 23 is greater than a first level (which corresponds to a high engine-loaded condition) and a positive-going signal otherwise; an output terminal b which carries a negative-going signal when the voltage on capacitor 23 is below a lower second predetermined level (which corresponds to an engine idle condition); and an output terminal c which carries a positive going signal whenever the voltage on the capacitor 23 is lower than a still lower third predetermined level (corresponding to an engine overrun condition).

The system includes a controlled current source 25 which is arranged to discharge the capacitors 21 and 22 in a controlled manner at a rate dependent on engine operating conditions. This rate is determined by a voltage signal from an exhaust control 26 coupled to an exhaust gas sensor, a cold start control 27 and the terminals a and b. The exhaust control 26 is arranged to be overridingly inhibited when there is a negative-going signal on the terminal a or b or when the cold start control 27 is in operation.

The engine is arranged to be fuelled by two electrically operated injectors operating from a fuel supply and spraying fuel alternately into the air intake manifold at positions adjacent the appropriate cylinders. The quantity of fuel injected is proportional to the time for which each injector is opened. An amplifier 28, 29 is provided for powering each injector and these amplifiers receive their inputs from a pair of comparators 30, 31 respectively. These comparators compare the voltage across the capacitors 21, 22 respectively with a reference voltage and produce an output to open the associated solenoids only when the voltage on the respective capacitor exceeds the reference voltage. Thus the time for which each solenoid is opened depends upon the voltage to which the associated capacitor 21 or 22 is charged initially and the rate at which it is subsequently discharged.

As noted above, the length of the pulses C, and therefore also the lengths of the pulses A and B, vary with the battery voltage and accordingly the time for which each gate 18 or 19 is open to charge the associated capacitor will vary with the battery voltage. There is thus a battery voltage-dependent addition to the length of time for which each injector is energised and this addition can be used to compensate for any voltage dependent lag in operation of the injectors.

Figure 2:
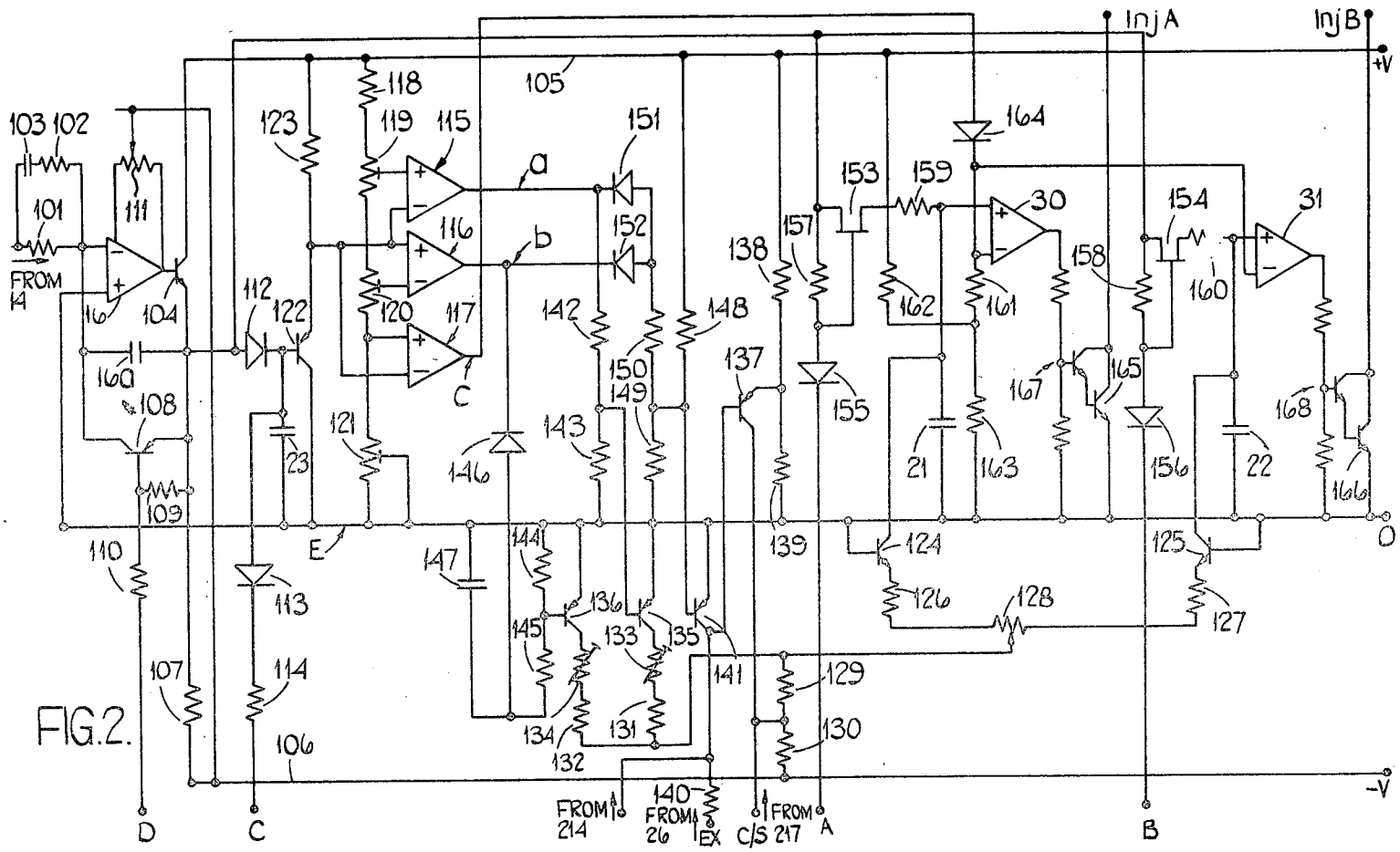
FIG. 2 is a rather more detailed electrical circuit diagram.

Turning now to FIG. 2, the complete circuit shown includes an operational amplifier acting as the integrator 16, the invert input terminal of which is connected to the mass flow meter 14 via a resistor 101 bridged by a resistor 102 and capacitor 103 in series. An n-p-n transistor 104 provides additional current gain for the operational amplifier, being connected as an emitter follower, with its base connected to the output terminal of the amplifier 16, its collector connected to a +rail 105, and its emitter connected to a −rail 106 by a resistor 107. The switch 17 of FIG. 1 is constituted by a p-n-p transistor 108 with its emitter connected to the emitter of the transistor 104 and its collector connected to the inverting input terminal of the amplifier 16. The base of the transistor 108 is connected to its emitter by a resistor 109 and also by a resistor 110 to the terminal D of the generator 15 (not shown in detail). Thus, the pulses D serve to reset the integrator 16 periodically in synchronism with operation of the engine. A potentiometer 111 is connected in known manner to the amplifier 16 for offset voltage compensation.

The voltage from the meter 14 becomes increasingly negative as mass flow increases to that the voltage attained by the capacitor 16*a* in a revolution of the engine will become increasingly positive as mass flow increases for a given engine speed. This voltage is applied to the capacitor 23 via a diode 112, the capacitor 23 being connected between the cathode of the diode 112 and an earth rail E to which the non-inverting terminal of the amplifier 16 is connected. The cathode of the diode 112 is also connected via a diode 113 and a resistor 114 to the terminal C so that the capacitor 23 which is periodically charged to a value representing fuel demand, is allowed to discharge to the required value when the fuel demand decreases.

The level detection circuit 24 of FIG. 1 is constituted by three voltage comparators 115, 116 and 117 the output terminals of which constitute the terminals a, b and c of FIG. 1. The three voltage levels referred to are set by means of a resistor chain constituted by a resistor 118, and three potentiometers 119, 120 and 121 connected in series between the rails 105 and E. The variable points of the potentiometers 119 and 120 are connected to the non-inverting input terminal of comparator 115 and the inverting input terminal of comparator 116 respectively, the junction of the potentiometers 120 and 121 is connected to the non-inverting input terminal of the comparator 117 and the variable point of the potentiometer 121 is connected to the rail E. The capacitor 23 is buffered by an emitter follower p-n-p transistor 122 which has its collector connected to rail E and its emitter connected to the rail 105 via a resistor 123 and also to the inverting input terminals of the comparators 115 and 117 and the non-inverting terminal of the comparator 116.

Turning now to the controlled current source 25 of FIG. 1, this is constituted by a pair of n-p-n transistors 124, 125 with their bases connected to the rail E and their emitters connected via resistors 126, 127 to opposite ends of a balance potentiometer 128. The slider of the potentiometer 128 is connected via a pair of resistors 129, 130 in series to the rail 106, and also via a pair of resistors 131, 132 and a pair of variable resistors 133, 134 to the collectors of two p-n-p transistors 135, 136 which have their emitters connected to the rail E. The common point of the resistors 129, 130 is connected to the output terminal of the cold start circuit 27 of FIG. 1 and also to the collector of a p-n-p transistor 137 which has its emitter connected to the common point of two resistors 138, 139 connected in series between the rails 105, E. The base of the transistor 137 is connected by a resistor 140 to the exhaust control circuit 26 of FIG. 1, and also to the collector of a p-n-p transistor 141 which has its emitter connected to the rail E.

The base of the transistor 135 is connected to the common point of two resistors 142, 143 connected in series between the output terminal of the comparator 115 and the rail E. The base of the transistor 136 is connected by a resistor 144 to the rail E, and by a resistor 145 to the anode of a diode 146 which has its cathode connected to the output terminal of the comparator 116. A capacitor 147 of relatively high capacitance is connected between the anode of the diode 146 and the rail E. The base of the transistor 141 is connected via a resistor 148 to the rail 105 so that it is normally biased off, and also via resistor 149 to the rail E and via a resistor 150 to the anodes of two diodes 151, 152 which have their cathodes connected to the output terminals of the comparators 115, 116 respectively. The transistor 141 becomes conductive, shorting any signal from the circuit 26 to the rail E, whenever either of the comparators 115, 116 produces a negative going output.

Assuming for the moment that the signals from both comparators 115 and 116 are positive going and the capacitor 147 is discharged both transistors 135, 136 will be off and have no control over the current which the transistors 124, 125 will pass. If the cold start circuit presents an effectively open circuit the voltage at the common point of resistors 129, 130 will be controlled only by the exhaust control circuit 26. The potential at the junction between the resistors 129 and 130, and the values of the resistor 129, the potentiometer 128 and the resistors 126 and 127 will determine the emitter and hence the collector currents of the transistors 124 and 125.

The exhaust control 26 provides an output signal varying according to the exhaust composition between say −2 and +2 volts, the voltage increasing when the fuel/air mixture fed to the engine is rich and decreasing when it is weak. Thus when the mixture is rich the voltage applied to the terminal marked Ex will rise and reduce the current drawn from the base of transistor 137. This in turn will decrease the collector current of transistor 137 and thereby lower the potential at the common point of the resistors 129, 130. This will cause an increase in the current drawn from transistor 124 or 125 when either of these is conducting to discharge the associated capacitor 21 or 22, thereby reducing the discharge time and so reducing the amount of fuel delivered. Similarly when the mixture is weak the potential at the junction of the resistors 129 and 130 will rise, reducing the current drawn from transistor 124 or 125, and thereby increasing the amount of fuel delivered.

Figures 3, 4:
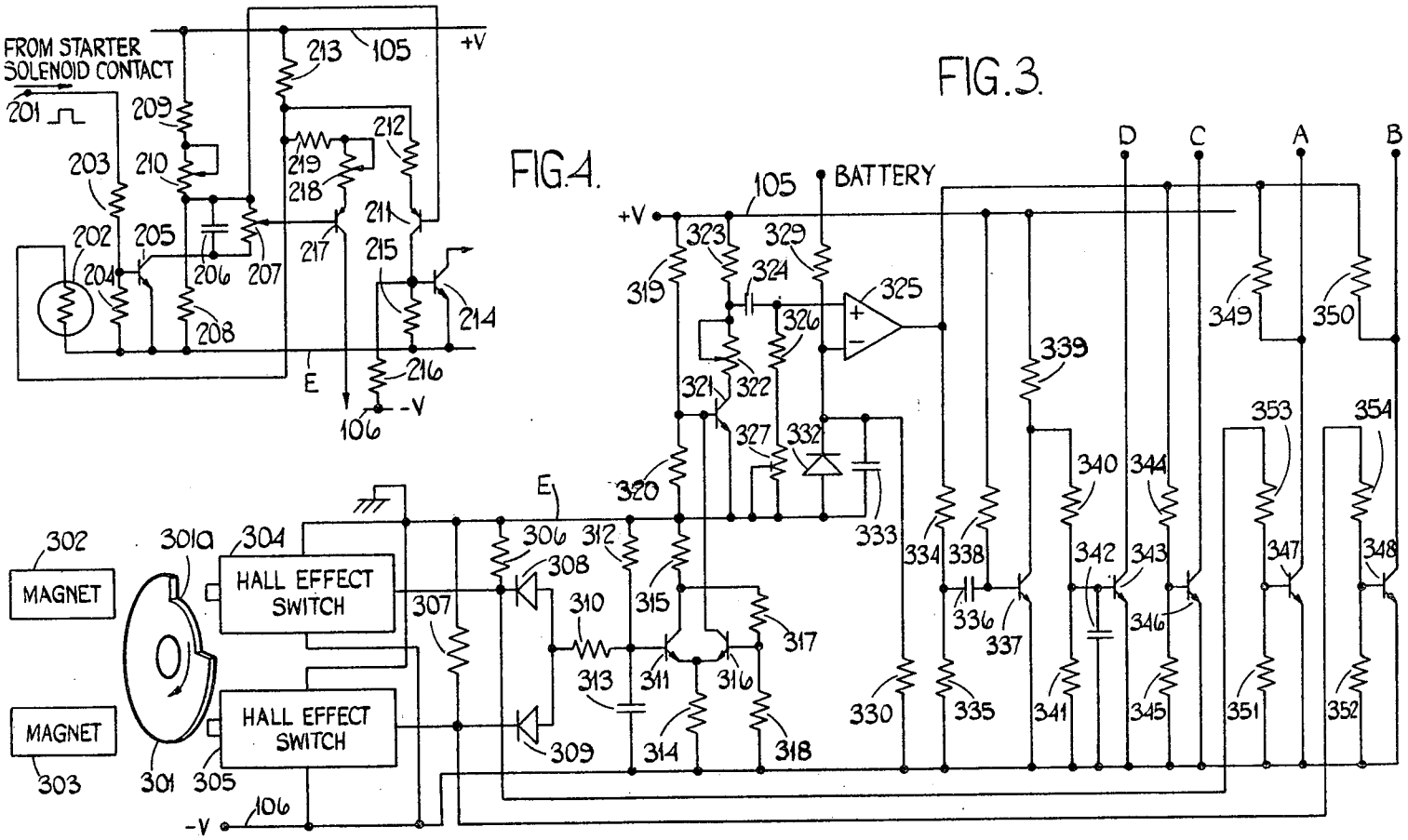
FIG. 3 is a detailed circuit diagram of a timing pulse generator.
FIG. 4 is a circuit diagram of a cold start enrichment circuit.

The cold start circuit is shown in FIG. 4 and has an input terminal 201 connected to the starter solenoid contact so that a 12 Volt pulse is applied to this terminal during cranking of the engine. The circuit also includes a thermistor 202 which is sensitive to the engine coolant temperature. The terminal 201 is connected by two resistors 203, 204 in series to the earth rail E their junction being connected to the base of an n-p-n transistor 205 the emitter of which is connected to the rail E. The collector of the transistor 205 is connected to one plate of a capacitor 206 across which there is connected a potentiometer 207. The other plate of the capacitor 206 is connected to the earth rail E by a resistor 208 and to the positive rail 105 by a variable-resistor 209 and a resistor 210 in series. The other plate of the capacitor 206 is also connected to the base of a p-n-p transistor 211 and the emitter of this transistor 211 is connected by a pair of resistors 212, 213 in series to the rail 105. The collector of the transistor 211 is connected to the base of an n-p-n transistor 214 which is connected to the rail E by a resistor 215 and to the rail 106 by a resistor 216. The emitter of the transistor 214 is connected to the rail E and the collector of transistor 214 is connected to the collector of the transistor 141 (FIG. 2) to short any signal thereon from the circuit 26 to earth whenever the transistor 214 is conductive.

The variable point of the potentiometer 207 is connected to the base of an n-p-n transistor 217 the emitter of which is connected via a variable resistor 218 and a resistor 219 in series to the junction of the resistor 212, 213. The thermistor 202 is connected between this same junction and the rail E and the collector of the transistor 217 is the output terminal of the circuit and is connected to the junction of the resistors 129, 130 and to the collector of transistor 137 (see FIG. 2).

When the thermistor 202 is cold there will be a relatively high voltage at the junction of resistors 212,123 which will be impressed on the emitters of the transistors 211 and 217. During cranking of the engine by its starter motor system the transistor 205 turns on and capacitor 206 then charges via the resistors 209,210. Once the capacitor 206 is fully charged the transistor 217 passes a current which depends on the engine temperature as sensed by the thermistor 202, the current increasing as engine temperature decreases. At the start of cranking, i.e. whilst capacitor 206 is still charging, an even greater current is passed by transistor 217. At the conclusion of cranking the capacitor 207 starts discharging via the resistor 207 (with a time constant of about 10 seconds) and this causes a gradual fall in the current passed by transistor 217 until a lower value is reached which depends only on engine temperature. This current disappears when the engine warms up. The controlled current from transistor 217 passes through resistor 130 thereby raising the voltage at the junction of resistors 129 and 130 and decreasing the rate of discharge of the capacitors 21, 22, so as to enrich the air/fuel mixture. Transistor 211 is also conductive, whenever the engine temperature is below normal and overrides the exhaust control by turning on transistor 214 which sinks the signal from the exhaust control.

During cranking with the engine already hot, the transistors 211 and 217 are not turned on although it may be desirable with some engines to provide some enrichment during hot cranking. In this case the values of the components of FIG. 4 are chosen to provide an output from transistor 217 during cranking (and for about 10 seconds thereafter).

During engine idling the output of the comparator 116 goes negative so that the transistor 136 is caused to conduct and reduce the currents in transistors 124 and 125 (so enriching the mixture). When the comparator 116 output reverts to its positive level, the capacitor 147 delays the return to a normal air fuel ratio. The negative output of the comparator 116 also turns on the transistor 141 to short the exhaust control signal to earth. Exhaust control is restored immediately the output of comparator 116 returns to positive. During periods when the engine is very heavily loaded the comparator 115 produces a negative output and the transistor 135 is switched into conduction to reduce the currents in the transistors 124,125 to enrich the mixture supplied to the engine and, once again exhaust control is overriden by turning on of the transistor 141 to short the exhaust signal to earth.

The collectors of transistors 124,125 are connected to the rail E by the respective signal storage capacitors 21 and 22. The gates 18 and 19 of FIG. 1 are constituted by two field effect transistors 153,154 respectively. The drain of each f.e.t. 153,154 is connected to the emitter of the transistor 104 and their gates are connected via diodes 155,156 respectively to the terminals A and B of the generator 15. A resistor 157,158 connects the drain of each f.e.t. to its gate and a further resistor 159,160 connects to the source of each f.e.t. to the associated capacitor 21 or 22.

The two comparators 30 and 31 have their non-inverting input terminals connected to the respective capacitors 21, 11 and their inverting input terminals connected together and via a resistor 161 to the common point of two resistors 162,163 connected in series between the rails 105 and E. These inverting input terminals are also connected via a diode 164 to the output terminal of the comparator 117 so that when the output of the comparator 117 goes positive the outputs of both comparators 30 and 31 remain negative. The output amplifiers 28 and 29 of FIG. 1 are constituted by Darlington transistors 165,166 driven by the respective comparator 30, 31 via potential dividers 167,168.

Referring to FIG. 3, the pulse generator 15 shown therein includes a steel disc 301 driven by the engine and having a 90° "window" 301*a* cut in its periphery. Associated with this disc there are two magnets 302,303 each of which has a Hall effect switch 304,305 of a known commercially available type associated with it. These switches 304, 305 are each connected between the rails E and 106 and each is such that when its magnet is aligned with the window 301*a* the output of the switch is at the potential of rail 106 and otherwise the output is at the potential of the rail E.

The output terminals of the two switches 304,305 are connected by two resistors 306,207 to the rail E and to the cathodes of two diodes 308, 309 the anodes of which are connected together and by a resistor 310 to the base of an n-p-n transistor 311. The base of the transistor 311 is connected to the rail E by a resistor 312 and to the rail 106 by a capacitor 313. The emitter of the transistor 311 is connected to the rail 106 by a resistor 314 and its collector is connected to the rail E by a resistor 315. A second n-p-n transistor 316 has its emitter connected to the emitter of the transistor 311 and its base connected to the junction of two resistors 317,318 connected in series between the collector of the transistor 311 and the rail 106. The two transistors 311 and 316 and their associated components form a Schmidt trigger circuit in which the transistor 311 is normally on, but which is turned off, rapidly turning the transistor 316 on when the output of either Hall effect switch goes negative.

The collector of the transistor 316 is connected to the junction of two resistors 319, 320 connected in series between the rails 105 and E. This junction is connected to the base of an n-p-n transistor 321 which has its emitter grounded to rail E and its collector connected to the rail 105 via a variable resistor 322 and a resistor 323 in series. Transistor 321 is normally biased to conduct but is switched off when the transistor 311 is switched off. This causes the potential at the collector of the transistor 321 to go sharply positive when the transistor 311 is switched off.

The junction of the resistors 322, 323 is connected via a capacitor 324 to the non-inverting input terminal of operational amplifier voltage comparator 325, this non-inverting input terminal being also connected by a resistor 326 and a variable resistor 327 in series to the earth rail E. The inverting input terminal of the comparator 325 is connected to the junction of two series resistors 329, 330 connecting a battery +terminal 331 to the −rail 106. The inverting input terminal is also connected to the cathode of a diode 332 which has its anode connected to the rail E and which is bridged by a capacitor 333. The diode 332 limits the degree to which the invert input terminal potential can fall below that on rail E. The signal impressed on the non-inverting input terminal has a sharp rising edge immediately followed by an exponentially falling trailing edge so that the length of time for which a positive output appears from the comparator 325 at each switching off of the transistor 311 will vary according to the battery voltage.

The output terminal of the comparator 325 is connected by two series resistors 334, 335 to the rail 106 and the interconnection of these resistors 334, 335 is connected via a capacitor 336 to the base of an n-p-n transistor 337 biased on by a resistor 338 connected to the rail 105. The emitter of the transistor 337 is connected to the rail 106 and its collector is connected by a resistor 339 to the rail 105 and by two resistors 340, 341 in series to the rail 106. The junction of the resistors 340, 341 is connected to the rail 106 by a capacitor 342 and is also connected to the base of an n-p-n transistor 343 which has its emitter connected to the rail 106 and its collector providing the output D.

A further series pair of resistors 344, 345 connects the output terminal of the comparator 325 to the rail 106 and the base of an n-p-n transistor 346 which has its emitter connected to the rail 106 and its collector providing the output C. The outputs A and B are provided by two transistors 347 and 348 which have their emitters connected to the rail 106 and their collectors connected by resistors 349, 350 respectively to the output terminal of the comparator 325. The bases of the two ransistors 347, 348 are connected to the rail 106 by respective resistors 351, 352 and to the cathodes of the diodes 308, 309 by respective resistors 353, 354. The transistors 347, 348 are normally on but each turns off when the output from the associated switch 304, 305 goes negative. At the same time (approximately) the output from the comparator 325 goes positive so that the output A or B goes positive for the duration of positive pulse from the comparator 325.

The mode of operation of the full circuit will be clear having regard to the foregoing general discussion of the invention and the description of FIG. 1 of the drawings.

I claim:

1. An internal combustion engine electronic fuel injection control comprising means for repeatedly generating a voltage signal related to the fuel requirements of the engine, signal storage means, gate means connected between the voltage signal generating means and said signal storage means, means sensitive to at least one engine operating parameter for discharging said signal storage means at a rate determined by said engine operating parameter, means connected to the gate means for opening the gate means during a predetermined part of each operating cycle of the engine, whereby said voltage signal is transferred to said signal storage means during said predetermined part, and for maintaining the gate means closed during other parts of each operating cycle of the engine, and means sensitive to the length of time which said signal storage means takes to discharge for controlling the quantity of fuel injected.

2. A control as claimed in claim 1, in which said signal storage means is a capacitor and said discharging means comprises a controlled current source connected to said capacitor and a circuit sensitive to said at least one engine parameter connected to control said controlled current source.

3. A control as claimed in claim 2, in which said gate means is a semiconductor switch.

4. A control as claimed in claim 3, in which said semiconductor switch is a field effect transistor.

5. A control as claimed in claim 2, in which said controlled current source includes a transistor having its base and collector connected across the capacitor and its emitter connected by a resistor chain to a supply rail at a fixed potential, said circuit sensitive to said at least one engine parameter being connected to a point in said resistor chain so as to vary the potential at said point.

6. A control as claimed in claim 5, in which said circuit sensitive to at least one engine parameter is a cold start circuit sensitive to engine temperature and connected to an engine starter system so as to provide enrichment during cold starting.

7. A control as claimed in claim 6, in which said cold start circuit includes a cold start capacitor which is connected so as to be charged when the engine starter system is energized and a transistor controlling current flow to said point in said resistor chain in accordance with the charge on said capacitor.

8. A control as claimed in claim 7, in which said cold start circuit further comprises a biasing circuit for said transistor including a thermistor sensitive to engine temperature so that the current passed by said transistor is also dependent on engine temperature.

9. A control as claimed in claim 1, in which the discharging means includes means sensitive to the output of said voltage signal generating means and arranged to vary the rate of discharge in accordance with said voltage.

10. A control as claimed in claim 9, in which said means sensitive to the output of said voltage signal generating means includes a pair of comparators arranged to operate respectively above and below two predetermined levels of said voltage signal to decrease the discharging current and thereby increase the amount of fuel injected.

11. A control as claimed in claim 1, in which said voltage signal generating means comprises an air mass flow sensor mounted in an air intake manifold of the engine and a meter circuit associated with said sensor providing a mass flow voltage signal varying with the mass flow rate at which air is aspirated into the engine, an integrator connected to said meter circuit to provide said voltage signal related to the fuel requirement of the engine and a reset circuit for resetting the integrator periodically in synchronism with the operation of the engine.

12. An internal combustion engine electronic fuel injection control comprising the combination of mass flow metering means associated with the engine and providing an electrical signal dependent on the mass flow rate of air into the engine, an electronic integrator connected to said metering means so as to integrate said electrical signal, a signal storage capacitor, gate means connecting said signal storage capacitor to the integrator, pulse generator means operated by the engine and connected to said gate means and to said integrator so as to periodically in synchronism with engine operation to open said gate means to permit loading of said signal storage capacitor with the output voltage of the integrator and immediately thereafter to reset said integrator, a controlled current source connected for discharging said capacitor, means sensitive to an engine operating parameter connected to said controlled current source controlling the rate of discharge of said capacitor in accordance with said engine operating parameter, comparator means connected to said capacitor and comparing the voltage thereon with a reference voltage and an injector power amplifier driven by said comparator and causing an associated fuel injector to open and admit fuel to the engine when the voltage on the capacitor exceeds the reference voltage.

13. A control as claimed in claim 12, in which said pulse generator is connected to a battery which also provides power to the injector, said pulse generator providing gate operating pulses of duration variable in accordance with the battery voltage, whereby compensation for variations in injector opening time resulting from battery voltage variations is obtained.

14. A control as claimed in claim 12, further comprising overriding means sensitive to the integrator output for decreasing the rate of discharge of said capacitor when the peak integrator output exceeds a first predetermined level or falls below a second lower predetermined level.

15. A control as claimed in claim 14, in which said overriding means includes a further capacitor connected to the integrator output by a diode so that the further capacitor can charge when the integrator output exceeds the voltage on the further capacitor, discharge means for said further capacitor, and further comparator means connected to said further capacitor and comparing the voltage thereon with voltages corresponding to said first and second predetermined levels.

16. A control as claimed in claim 15, in which said discharge means forms a part of said pulse generator and includes a transistor having its collector-emitter path connected through a series resistor to said further capacitor to provide a discharge path for said further capacitor if the integrator output voltage is less than the capacitor voltage, to permit the capacitor voltage to fall to the existing output voltage of the integrator.

17. A control as claimed in claim 15, in which the controlled current source comprises a transistor having its base-collector connected across the signal storage capacitor, a resistor chain connecting the emitter of said transistor to a fixed potential supply rail, and means for applying an exhaust gas feedback signal via a further transistor to one point in the resistor chain, said further comparator means being connected to said further transistor to override the exhaust feedback.

18. A control as claimed in claim 17, in which said further comparator means comprises first and second voltage comparators both producing a positive going outout when the voltage on said further capacitor is between said first and second predetermined values and producing negative going voltages when the voltage on said further capacitor is above said first predetermined value and below said second predetermined value respectively, first and second additional transistors with their bases connected to the outputs of the first and second voltage comparators respectively, emitters of said additional transistors being connected to the base of the first mentioned transistor, first and second variable resistors connected to the outputs of the first and second voltage comparators respectively, emitters of said additional transistors being connected to the base of said first mentioned transistor, first and second variable resistors connecting the collectors of the first and second additional transistors to a different point in said resistor chain and diodes connecting the first and second comparator outputs to the base of said further transistor, whereby when the output of one of said voltage comparators goes negative, the current source passes a current determined by the associated one of the variable resistors.

19. A control as claimed in claim 15, in which said further comparator means includes an additional voltage comparator connected to said further capacitor and arranged to compare the voltage on said further capacitor with a third and still lower predetermined voltage level, said additional voltage comparator being connected to the first mentioned comparator means to increase the reference voltage and thereby prevent the first mentioned comparator from producing an injector opening output when the voltage on said further capacitor is below said third predetermined level.

20. A control as claimed in claim 12, in which said means sensitive to an engine parameter comprises means normally determining the current passed by said controlled current source and a cold start circuit for overriding said normal means and including means connected in the engine starter system and means sensitive to the engine temperature and coacting to reduce the normal current passed by the controlled current source for at least the duration of cranking of the engine.

* * * * *